US005259983A

United States Patent [19]

Van Der Puy et al.

[11] Patent Number: 5,259,983

[45] Date of Patent: Nov. 9, 1993

[54] AZEOTROPE-LIKE COMPOSITIONS OF 1-H-PERFLUOROHEXANE AND TRIFLUOROETHANOL OR N-PROPANOL

[75] Inventors: Michael Van Der Puy, Cheektowaga; Richard E. Eibeck, Orchard Park, both of N.Y.

[73] Assignee: Allied Signal Inc., Morristown, N.J.

[21] Appl. No.: 873,857

[22] Filed: Apr. 27, 1992

[51] Int. Cl.[5] ..... C11D 7/30; C11D 7/50; C23G 5/028; B08B 3/00

[52] U.S. Cl. ..... 252/171; 134/12; 134/31; 134/38; 134/40; 134/42; 252/153; 252/162; 252/170; 252/364; 252/DIG. 9

[58] Field of Search ..... 252/153, 162, 170, 171, 252/364, DIG. 9; 134/12, 31, 38, 40, 42

[56] References Cited

U.S. PATENT DOCUMENTS

| | | | |
|---|---|---|---|
| 4,770,714 | 9/1988 | Buchwald et al. | 134/40 |
| 4,828,751 | 5/1989 | Kremer | 252/171 |
| 5,055,138 | 10/1991 | Slinn | 134/11 |
| 5,059,728 | 10/1991 | Li et al. | 570/134 |
| 5,064,559 | 11/1991 | Merchant et al. | 252/171 |
| 5,073,288 | 12/1991 | Anton . | |
| 5,073,290 | 12/1991 | Anton et al. . | |
| 5,076,956 | 12/1991 | Anton . | |
| 5,100,572 | 3/1992 | Merchant | 252/171 |
| 5,135,676 | 8/1992 | Buchwald et al. | 252/171 |

FOREIGN PATENT DOCUMENTS

| | | |
|---|---|---|
| 350316 | 1/1990 | European Pat. Off. . |
| 431458 | 6/1991 | European Pat. Off. . |
| 432672 | 6/1991 | European Pat. Off. . |
| 450308 | 10/1991 | European Pat. Off. . |
| 3-252500 | 11/1991 | Japan . |

OTHER PUBLICATIONS

*CRC Handbook of Chemistry & Physics*, 1982–1983 (63rd) edition, Robert C. Weast, ed., Melvin J. Astle, assoc. ed., p. C-290.

*Concise Chemical & Technical Dictionary*, 1974 (3rd) edition, H. Bennett, ed., p. 1067.

Aldrich Chemical Company Catalog of Fine Chemicals 1990–1991 Catalogue No. 32,674-7 copyright 1990.

Aldrich Chemical Company Catalog of Fine Chemicals 1992–1993 Catalogue No. 32,674-7 copyright 1992.

*Primary Examiner*—Linda Skaling

*Attorney, Agent, or Firm*—Darryl L. Webster; Melanie L. Brown

[57] ABSTRACT

Azeotrope-like compositions comprising 1-H-perfluorohexane and trifluoroethanol or n-propanol and optionally nitromethane are stable and have utility as degreasing agents and as solvents in a variety of industrial cleaning applications including cold cleaning and defluxing of printed circuit boards and dry cleaning.

18 Claims, No Drawings

AZEOTROPE-LIKE COMPOSITIONS OF 1-H-PERFLUOROHEXANE AND TRIFLUOROETHANOL OR N-PROPANOL

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

Azeotropic or azeotrope-like compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is azeotrope-like, fractionation will occur and undesirable solvent distribution may act to upset the cleaning and safety of processing. Preferential evaporation of the more volatile components of the solvent mixtures, which would be the case if they were not azeotrope-like, would result in mixtures with changed compositions which may have less desirable properties, such as lower solvency towards soils, less inertness towards metal, plastic or elastomer components, and increased flammability and toxicity. The art has looked towards azeotrope or azeotrope-like compositions including the desired fluorocarbon components such as trichlorotrifluoroethane which include components which contribute additionally desired characteristics, such as polar functionality, increased solvency power, and stabilizers.

The art is continually seeking new fluorocarbon, hydrofluorocarbon, and hydrochlorofluorocarbon based azeotrope-like mixtures which offer alternatives for new and special applications for vapor degreasing and other cleaning applications. Currently, of particular interest, are fluorocarbon, hydrofluorocarbon, and hydrochlorofluorocarbon based azeotrope-like mixtures with minimal or no chlorine which are considered to be stratospherically safe substitutes for presently used chlorofluorocarbons (CFCs). The latter are suspected of causing environmental problems in connection with the earth's protective ozone layer. Mathematical models have substantiated that hydrofluorocarbons, such as 1-H-perfluorohexane, will not adversely affect atmospheric chemistry, being negligible contributors to ozone depletion and to green-house global warming in comparison to chlorofluorocarbons such as 1,1,2-trichloro-1,2,2-trifluoroethane (CFC-113).

U.S. Pat. Nos. 5,073,288; 5,073,290; and 5,076,956 teach binary and ternary azeotrope-like compositions having 1,1,1,2,2,3,5,5,5-nonafluoro-4-trifluoromethylpentane and/or 1,1,1,2,2,5,5,5-octafluoro-4-trifluoromethylpentane therein. European Publication 350,316 published Jan. 10, 1990 teaches that 1-H-perfluorohexane may be used in a cleaning method wherein a layer of highly fluorinated organic compound transfers heat to a layer of organic solvent.

DETAILED DESCRIPTION OF THE INVENTION

Our solution to the need in the art for substitutes for chlorofluorocarbon solvents is mixtures comprising 1-H-perfluorohexane and trifluoroethanol or n-propanol; and optionally nitromethane. Also, novel azeotrope-like or constant-boiling compositions have been discovered comprising 1-H-perfluorohexane and trifluoroethanol and n-propanol; and optionally nitromethane.

Preferably, the novel azeotrope-like compositions comprise effective amounts of 1-H-perfluorohexane and trifluoroethanol or n-propanol; and optionally nitromethane. The term "effective amounts" as used herein means the amount of each component which upon combination with the other component, results in the formation of the present azeotrope-like compositions.

The azeotrope-like compositions comprise from about 60 to about 90 weight percent 1-H-perfluorohexane and from about 10 to about 40 weight percent trifluoroethanol and from 0 to about 1 weight percent nitromethane. Also, azeotrope-like compositions comprise from about 83 to about 99 weight percent 1-H-perfluorohexane and from about 1 to about 17 weight percent n-propanol and from 0 to about 5 weight percent nitromethane.

The present azeotrope-like compositions are advantageous for the following reasons. The 1-H-perfluorohexane component is a negligible contributor to ozone depletion, has a boiling point of about 68°-70° C., has no flashpoint, and is compatible with a wide variety of materials including plastics. Trifluoroethanol has a boiling point of about 78° C. and a flashpoint of about 29° C. and has good solvent properties. The n-propanol has a boiling point of about 97.2° C. and has good solvent properties. Thus, when these components are combined in effective amounts, an efficient azeotrope-like solvent results.

The preferred azeotrope-like compositions are in the Table below. In the Table, the numerical ranges are understood to be prefaced by "about".

| COMPONENTS | PREFERRED RANGE (WT. %) | MORE PREFERRED RANGE (WT. %) | MOST PREFERRED RANGE (WT. %) | BOILING POINT (°C.) (760mmHg) |
|---|---|---|---|---|
| 1-H-Perfluorohexane | 60-90 | 63-90 | 65-88 | 59.7 ± 0.7 |
| Trifluoroethanol | 10-40 | 10-37 | 12-35 | |
| Nitromethane | 0-1 | 0-0.5 | 0-0.4 | |
| 1-H-Perfluorohexane | 83-99 | 90-99 | 92-95 | 66.7 ± 1 |
| n-propanol | 1-17 | 1-10 | 5-8 | |
| Nitromethane | 0-5 | 0-3 | 0-1.5 | |

All compositions within the indicated ranges, as well as certain compositions outside the indicated ranges, are azeotrope-like, as defined more particularly below.

The precise azeotrope compositions have not been determined but have been ascertained to be within the above ranges. Regardless of where the true azeotropes lie, all compositions with the indicated ranges, as well as certain compositions outside the indicated ranges, are azeotrope-like, as defined more particularly below.

It has been found that these azeotrope-like compositions are on the whole nonflammable liquids, i.e. exhibit no flash point when tested by the Tag Open Cup test method ASTM D 1310-86 and Tag Closed Cup Test Method ASTM D 56-82.

The term "azeotrope-like composition" as used herein is intended to mean that the composition behaves like an azeotrope, i.e. has constant-boiling characteristics or a tendency not to fractionate upon boiling or evaporation. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree. As is readily understood by persons skilled in the art, the boiling point of the azeotrope-like composition will vary with the pressure.

The azeotrope-like compositions of the invention are useful as solvents in a variety of vapor degreasing, cold cleaning and solvent cleaning applications including defluxing and dry cleaning.

In the process embodiment of the invention, the azeotrope-like compositions of the inventions may be used to clean solid surfaces by treating said surfaces with said compositions in any manner well known to the art such as by dipping or spraying or use of conventional degreasing apparatus. In one process embodiment of the invention, the azeotrope-like compositions of the invention may be used to dissolve contaminants or remove contaminants from the surface of a substrate by treating the surfaces with the compositions in any manner well known to the art such as by dipping or spraying or use of conventional degreasing apparatus wherein the contaminants are substantially removed or dissolved.

The 1-H-perfluorohexane of the present invention may be prepared by a variety of known methods such as taught by U.S. Pat. No. 2,490,764. For example, 1-H-perfluorohexane may be made by decarboxylation of the potassium salt of perfluoroheptanoic acid as taught by J. LaZerte et al., "Pyrolyses of the Salts of the Perfluorocarboxylic Acids", J. Am. Chem. Soc. 75, 4525 (1953). Alternatively, 1-H-perfluorohexane may be made by fluorination of $H(CF_2)_6X$ where X is halogen other than fluorine. An example of this is the conversion of $H(CF_2)_6Cl$ to $H(CF_2)_6F$ with $SbF_5$ as described in U.S. Pat. No. 2,490,764. Finally, 1-H-perfluorohexane may be prepared by reduction of $CF_3(CF_2)_5X$ where X is halogen other than fluorine. One such preparation is given in Example 1. The trifluoroethanol; n-propanol; and nitromethane components of the novel solvent azeotrope-like compositions of the invention are known materials and are commercially available.

Other components may advantageously be present in the present azeotrope-like mixtures. In particular, compounds of formula $H(CF_2)_nF$ where n is greater than 6, may be present. These compounds may act to further reduce the aggressive nature of the liquid mixture containing trifluoroethanol, while maintaining the desired nonflammability. These higher homologs have substantially higher boiling points (96° C. and higher) compared to $H(CF_2)_6F$.

EXAMPLE 1

This Example is directed to the preparation of 1-H-perfluorohexane. 1-Iodoperfluorohexane (63.1 grams, 0.14 mole) was added over 1 hour to 51.0 grams (0.175 mole) tri-n-butyltin hydride (nitrogen atmosphere), keeping the temperature below 70° C. The mixture was then allowed to cool and the lower layer separated and distilled to give 37.2 grams 1-H-perfluorohexane, bp 68°-70° C. The fraction boiling between 69° and 69.5° C., which was 99.9% pure, was used in the azeotrope determinations. 1H NMR (CDC13): δ 6.06 (tt, J=5 and 52 Hz).

EXAMPLE 2

The composition range over which 1H-perfluorohexane and trifluoroethanol exhibit constant boiling behavior was determined using ebulliometry. The ebulliometer consisted of a heated sump in which the hydrofluorocarbon was brought to a boil. The upper part of the sump was cooled, thereby acting as a condenser for the boiling vapors, allowing the system to operate at total reflux. After bringing the 1-H-perfluorohexane to a boil at atmospheric pressure (749 mm Hg), measured amounts of trifluoroethanol were titrated into the ebulliometer. The change in boiling point was measured using a (calibrated ASTM) mercury thermometer graduated from 50° to 80° C. in 0.1° C. increments. The results are as follows:

| WEIGHT PERCENT $CF_3CH_2OH$ | TEMPERATURE (°C.) |
|---|---|
| 0.0 | 69.90 |
| 1.9 | 65.00 |
| 3.9 | 61.90 |
| 6.2 | 61.60 |
| 9.4 | 60.55 |
| 12.6 | 59.15 |
| 16.0 | 59.05 |
| 18.7 | 59.05 |

-continued

| WEIGHT PERCENT $CF_3CH_2OH$ | TEMPERATURE (°C.) |
|---|---|
| 21.4 | 58.95 |
| 24.4 | 58.95 |
| 27.3 | 58.95 |
| 30.2 | 59.05 |
| 33.1 | 59.15 |
| 37.0 | 59.30 |

The above results thus indicate that compositions of 1-H-perfluorohexane and trifluoroethanol ranging from about 10 to about 40 weight percent trifluoroethanol and from about 90 to about 60 weight percent 1-H-perfluorohexane exhibit constant boiling behavior at about 59.1° C.±0.7° C. at 749 mm Hg.

EXAMPLE 3

The flashpoint of a 63/37 weight percent mixture of 1-H-perfluorohexane and trifluoroethanol respectively, was determined using the SETA flash closed-cup tester. The mixture failed to exhibit a closed-cup flashpoint up to an operating temperature of 144° F. (62° C.), the approximate boiling point of the mixture. Consequently, all azeotrope-like compositions having greater than 63 weight percent $CF_3(CF_2)_5H$ would also be expected not to have a SETA flashpoint, since they would have higher proportions of the nonflammable hydrofluorocarbon component.

EXAMPLE 4

The ability of a liquid composition to clean in cold cleaning, precision cleaning and related applications is highly dependent upon the ability of the material to substantially dissolve greases, oils, fluxes, and other contaminants (as opposed to physically removing soils as by wiping or spraying). We have therefore determined the solubility of model soils in the novel azeotropic solvent as an indication of its utility in cleaning applications. A mixture was made comprising 37 weight percent trifluoroethanol and 63 weight percent 1-H-perfluorohexane. The solubility of a commercial semi-synthetic metal working fluid was determined in this mixture as a function of temperature. At 25° C., the solubility of the working fluid was 5 volume percent and at 43° C., its solubility was 7.4 volume percent in the azeotrope mixture. By comparison, the solubility of the working fluid in CFC-113 ($CF_2ClCFCl_2$), which is widely used in solvent cleaning applications, was essentially zero at 25° C. and only about 1 volume percent at reflux (47° C.).

EXAMPLE 5

In a manner analogous to that of Example 2, the composition range over which 1-H-perfuorohexane and 1-propanol exhibit constant boiling (at 747 mm Hg) behavior was determined. The results were as follows:

| WEIGHT PERCENT N—PrOH | TEMPERATURE (°C.) |
|---|---|
| 0.0 | 69.90 |
| 1.06 | 67.20 |
| 2.11 | 66.20 |
| 3.02 | 66.00 |
| 3.50 | 65.90 |
| 3.87 | 65.90 |
| 4.50 | 65.85 |
| 5.15 | 65.80 |
| 5.77 | 65.70 |
| 6.50 | 65.70 |

-continued

| WEIGHT PERCENT N—PrOH | TEMPERATURE (°C.) |
|---|---|
| 7.26 | 65.70 |
| 8.04 | 65.70 |
| 9.06 | 65.75 |
| 10.08 | 65.80 |
| 11.27 | 65.85 |
| 12.36 | 65.90 |
| 13.84 | 66.20 |

The results indicated that compositions of 1-H-perfluorohexane and n-propanol ranging from about 1 to about 17 weight percent n-propanol and from about 99 to about 83 weight percent 1-H-perfluorohexane exhibit constant boiling behavior at about 65.7° C.±1° C. at 747 mm Hg.

EXAMPLE 6

The flashpoint of a 92.7/7.3 weight percent mixture of 1-H-perfluorohexane and n-propanol, respectively, was determined using the SETA flash closed-cup tester. The mixture failed to exhibit a closed-cup flashpoint up to an operating temperature of 150° F. (66° C.), the approximate boiling point of the mixture. Consequently, all azeotrope-like compositions having greater than 92.7 weight percent $CF_3(CF_2)_5H$ would also be expected not to have a SETA flashpoint, since they would have higher proportions of the nonflammable hydrofluorocarbon component.

Known additives may be used in the present-azeotrope-like compositions in order to tailor the composition for a particular use. Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: alkanols having 4 to 7 carbon atoms, nitroalkanes having 1 to 3 carbon atoms, 1,2-epoxyalkanes having 2 to 7 carbon atoms, phosphite esters having 12 to 30 carbon atoms, ethers having 3 or 4 carbon atoms, unsaturated compounds having 4 to 6 carbon atoms, acetals having 4 to 7 carbon atoms, ketones having 3 to 5 carbon atoms, and amines having 6 to 8 carbon atoms. Other suitable inhibitors will readily occur to those skilled in the art. In spraying applications, the azeotrope-like compositions may be sprayed onto a surface by using a propellant.

The inhibitors may be used alone or in mixtures thereof in any proportions. Typically, up to about 2 percent based on the total weight of the azeotrope-like composition of inhibitor might be used.

What is claimed is:

1. Azeotrope-like compositions consisting essentially of from about 60 to about 90 weight percent of 1-H-perfluorohexane and from about 10 to about 40 weight percent of trifluoroethanol and from 0 to about 1 weight percent nitromethane wherein said trifluoroethanol boils at about 78° C. and has a flashpoint of 29° C. said compositions boil at about 59° C. at 749 mm Hg.

2. The azeotrope-like compositions of claim 1 consisting essentially of from about 63 to about 90 weight percent said 1-H-perfluorohexane and from about 10 to about 37 weight percent said trifluoroethanol, and from about 0 to about 0.5 weight percent said nitromethane.

3. The azeotrope-like compositions of claim 1 consisting essentially of from about 65 to about 88 weight percent said 1-H-perfluorohexane and from about 12 to about 35 weight percent said trifluoroethanol, and from about 0 to about 0.4 weight percent said nitromethane wherein said compositions boil at about 59° C. at 749 mm Hg.

4. Azeotrope-like compositions consisting essentially of from about 83 to about 99 weight percent 1-H-perfluorohexane and from about 1 to about 17 weight percent n-propanol and from about 0 to about 5 weight percent nitromethane wherein said compositions boil at about 65.7° C. at 747 mm Hg.

5. The azeotrope-like compositions of claim 4 consisting essentially of from about 90 to about 99 weight percent said 1H-perfluorohexane and from about 1 to about 10 weight percent said n-propanol and from about 0 to about 3 weight percent said nitromethane.

6. The azeotrope-like compositions of claim 4 consisting essentially of from about 92 to about 95 weight percent said 1-H-perfluorohexane and from about 5 to about 8 weight percent said n-propanol and from about 0 to about 1.5 weight percent said nitromethane.

7. The azeotrope-like compositions of claim 1 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having other than said 1,2 epoxyalkanes or said acetals having 3 or 4 carbon atoms having 3 or 4 carbon atoms, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

8. The azeotrope-like compositions of claim 2 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having 3 or 4 carbon atoms other than said 1,2 epoxyalkanes or said acetals, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

9. The azeotrope-like compositions of claim 3 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having 3 or 4 carbon atoms other than said 1,2 epoxyalkanes or said acetals, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

10. The azeotrope-like compositions of claim 4 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having 3 or 4 carbon atoms other than said 1,2 epoxyalkanes or said acetals, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

11. The azeotrope-like compositions of claim 5 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having 3 or 4 carbon atoms other than said 1,2 epoxyalkanes or said acetals, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

12. The azeotrope-like compositions of claim 6 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having 3 or 4 carbon atoms other than said 1,2 epoxyalkanes or said acetals, ketones having 3 to 5 carbon atoms, and amines having 6 to 8 carbon atoms; wherein said inhibitor is present in sufficient amount to accomplish at least one of the following: inhibit decomposition of the compositions; react with undesirable decomposition products of the compositions; and prevent corrosion of metal surfaces.

13. A method of dissolving contaminants or removing contaminants from the surface of a substrate which comprises the step of:

treating said surface with said azeotrope-like composition of claim 1 as solvent.

14. A method of dissolving contaminants or removing contaminants from the surface of a substrate which comprises the step of:

treating said surface with said azeotrope-like composition of claim 2 as solvent.

15. A method of dissolving contaminants or removing contaminants from the surface of a substrate which comprises the step of:

treating said surface with said azeotrope-like composition of claim 3 as solvent.

16. A method of dissolving contaminants or removing contaminants from the surface of a substrate which comprises the step of:

treating said surface with said azeotrope-like composition of claim 4 as solvent.

17. A method of dissolving contaminants or removing contaminants from the surface of a substrate which comprises the step of:

treating said surface with said azeotrope-like composition of claim 5 as solvent.

18. A method of dissolving contaminants or removing contaminants from the surface of a substrate which comprises the step of:

treating said surface with said azeotrope-like composition of claim 6 as solvent.

* * * * *

UNITED STATES PATENT AND TRADEMARK OFFICE

CERTIFICATE OF CORRECTION

PATENT NO. : 5,259,983

DATED : November 9, 1993

INVENTOR(S) : M. Van Der Puy and R. Eibeck

It is certified that error appears in the above-identified patent and that said Letters Patent is hereby corrected as shown below:

Column 7:

Please rewrite claim 7 as follows:

7. The azeotrope-like compositions of claim 1 wherein said compositions further consist essentially of an inhibitor selected from the group consisting of alkanols having 4 to 7 carbon atoms, nitroalkanes having 2 to 3 carbon atoms, 1,2-epoxyalkanes having 2 to 7 carbon atoms, phosphite esters having 12 to 30 carbon atoms, acetals having 4 to 7 carbon atoms, ethers having <u>3 or 4 carbon atoms</u> other than said 1,2-epoxyalkanes or said acetals [having 3 or 4 carbon atoms having 3 or 4 carbon atoms,], ketones having 3 to 5 carbon atoms, and amines having 6 to 8 carbons atoms; wherein said inhibitor is present in sufficient amount to accomplish at least one of the following: inhibit decomposition of the compositions; react with undersirable decomposition products of the compositions; and prevent corrosion of metal surfaces.

Signed and Sealed this

Twenty-third Day of August, 1994

Bruce Lehman

*Attest:*

BRUCE LEHMAN

*Attesting Officer*

*Commissioner of Patents and Trademarks*